United States Patent [19]

Pepin

[11] 4,032,104

[45] June 28, 1977

[54] INGOT CASTING MOULD IN PARTICULAR FOR FERROMANGANESE

[75] Inventor: Francis Joseph Antoine Pepin, Nancy, France

[73] Assignee: Societe Nouvelle des Acieries de Pampey, Neuilly-sur-Seine, France

[22] Filed: Feb. 24, 1976

[21] Appl. No.: 660,786

[30] Foreign Application Priority Data

Feb. 26, 1975 France ..... 75.06041

[52] U.S. Cl. ..... 249/114; 249/174

[51] Int. Cl.² ..... B22D 7/06

[58] Field of Search ..... 249/114, 115, 160, 174, 249/204; 164/DIG. 6

[56] References Cited

UNITED STATES PATENTS

| | | | |
|---|---|---|---|
| 356,669 | 1/1887 | Stevens | 249/160 X |
| 387,174 | 7/1888 | McCleane et al. | 249/160 X |
| 404,381 | 6/1889 | Clark | 249/115 X |
| 3,357,481 | 12/1967 | Snyder | 249/114 X |
| 3,477,682 | 11/1969 | Shupe | 249/174 X |
| 3,783,933 | 1/1974 | Leedy | 249/204 X |
| 3,933,335 | 1/1976 | Maruyama et al. | 249/114 |

FOREIGN PATENTS OR APPLICATIONS

| | | | |
|---|---|---|---|
| 227,392 | 5/1963 | Austria | 249/160 |
| 651,417 | 2/1929 | France | 249/114 |
| 880,807 | 10/1961 | United Kingdom | 249/174 |

*Primary Examiner*—Ronald J. Shore
*Attorney, Agent, or Firm*—Kenyon & Kenyon, Reilly, Carr & Chapin

[57] ABSTRACT

The invention is concerned with an ingot casting mould closed at both its ends and comprising a first section the bottom wall of which is provided with a refractory layer, intended to receive a molten metal stream, a second section having an inclined bottom rising progressively from the adjacent edge of this layer and a third section having a flat bottom connected to the upper edge of the inclined bottom of said second section. This ingot casting mould is particularly suitable for the casting of materials such as ferromanganese which are highly corrosive with respect to cast iron.

4 Claims, 6 Drawing Figures

INGOT CASTING MOULD IN PARTICULAR FOR FERROMANGANESE

The present invention has for its object a novel ingot casting mould whose resistance to corrosion by the molten metal poured into the said ingot mould is considerably improved as compared with the usual ingot moulds.

The invention applies more particularly to the casting of ferromanganese which must be at a very high temperature and which, owing to its considerable corrosive power with respect to cast iron, at the pouring temperature, does not allow the use of conventional cast-iron ingot-moulds or other like casting devices or structures.

It is known that, on grounds of cleanness of the ferromanganese recovered after the casting, the latter is generally carried out with the aid of casting chains, using cast-iron chain buckets into which the molten metal is poured, or on cast-iron slabs.

Such techniques have the following drawbacks :

where continuously driven cast-iron buckets are used, corrosion or wear of the cast-iron walls rapidly leads to the formation of cavities, resulting in adherences of the cooled mass to the walls of the buckets and therefore in stripping problems; moreover, owing to the necessarily relatively small dimensions of such buckets, there takes places too rapid a cooling of the ferromanganese so that, owing to the too high internal stresses, the final fragmented product obtained is finer in grain size than the one desired by customers;

in the case of casting on cast-iron slabs, there also occurs an extremely rapid attack of the cast iron; moreover, the final product, which also is obtained in fragmented form, comprises too large a number of fragments and it is generally necessary to perform a subsequent crushing operation in order to obtain ferromanganese with the desired grain size.

The ingot casting mould of the present invention allows the aforementioned drawbacks to be remedied by considerably diminishing the corrosion of cast iron by the molten metal and by leading to the direct obtention, in the case of ferromanganese, of a product having the generally required grain size.

The ingot casting mould according to the present invention, having a cast-iron body, is characterized in that it comprises a first section of the said body, preferably placed at one end of the ingot mould, the bottom wall of this section being provided with a refractory material layer in the form of a plate or lining which is intended to receive the metal stream, a second section of the said body having an inclined bottom wall rising progressively from the adjacent edge of the said plate, and a third, flat bottom section.

Owing to the use of the aforesaid second upgrade section, the liquid metal cannot flow into the third section before reaching the top of the said upgrade; also, before the said level is reached and after it is reached, the liquid metal makes way and/or flows in the bottom of the ingot mould, using the whole width of the latter; as a result, the corrosion and/or erosion is not concentrated at the center-line of the ingot mould and takes place in such a manner that the consumption of the ingot mould cast iron by way of corrosion and/or erosion per unit of mass of the product obtained is already considerably diminished for this sole reason; moreover, the use of a refractory plate receiving the liquid metal while the latter is at the highest temperature allows rapid erosion of the corresponding region of the mould bottom to be avoided. In addition, owing to the upper surface of the said plate being located at the lowest level of the mould bottom, a liquid metal bed at very high temperature is immediately formed at the surface of the plate, so that the liquid metal at very high temperature cannot come into contact with the bottom of the mould portions which are remote from the point of impact of the metal stream, at least as long as the liquid metal has not undergone a sufficiently important cooling. These various reasons contribute to the obtention of a single effect to a maximum extent, i.e. the reduction of cast-iron consumption with respect to the production of the product sought the reduction factor being for example on the order of 5 to 10 for ferromanganese.

According to a preferred form of embodiment of the present invention, the aforesaid refractory plate or refractory lining is of carbon; if appropriate, it may be of special refractory steel or any other highly refractory metal or alloy or highly refractory mineral substance, these various materials being also selected according to the nature of the metal to be casted, in such a manner that the chemical affinity between this metal and the said material be as low as possible under the casting conditions considered.

The ingot mould according to the present invention may be constituted by a single element; however, owing to the importance of each melt which has to be carried out in the conventional industrial practice and the important mould masses and lengths resulting therefrom, the ingot mould of the present invention is preferably constituted by a plurality of longitudinally juxtaposable elements, the first one of which preferably includes at least the aforesaid first and second sections and is open at its downstream end, whereas the intermediate elements are open at both ends and the last element or downstream element is open at its upstream end and closed at its downstream end.

Of course, according to another form of embodiment of the present invention which does not presently seem to correspond to a current case of industrial practice, there can be provided an ingot casting mould in which the aforesaid first section provided with the refractory lining or plate is arranged at an intermediate location of the mould length, the said section being surrounded, at each of its two sides, with a second section of the aforesaid type with an inclined bottom, as indicated previously, so that when the liquid metal reaches the upper portion of the upgrades constituted by the said inclined bottoms, the metal may thereafter flow, at either side of the liquid metal feeding region, in the remaining free portions of the mould.

Other purposes, features and advantages of the present invention will appear as the following description proceeds.

In the appended drawing given solely by way of example:

Figure 1:
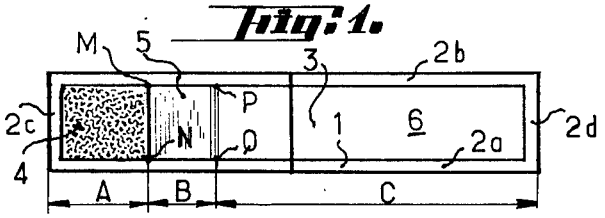
FIG. 1 is a diagrammatic top view of an ingot casting mould according to a first form of embodiment of the present invention, the said mould being constituted by a single element.

The ingot casting mould of FIG. 1 comprises a cast-iron body 1 including side walls 2*a* and 2*b*, end walls 2*c* and 2*d* and a bottom wall 3 whose shape and structure are not uniform from one end of the mould to the other, in such a manner as to define three sections A, B and C along the said mould; section A is provided with a refractory plate 4 intended to receive the metal stream whereas the bottom of section B is constituted by an upgrade sloping gently from the edge MN located substantially at the level of the upper surface of the plate 4 up to the region PQ; section C has a flat bottom 6 located substantially at the level of the region PQ.

Figure 2:
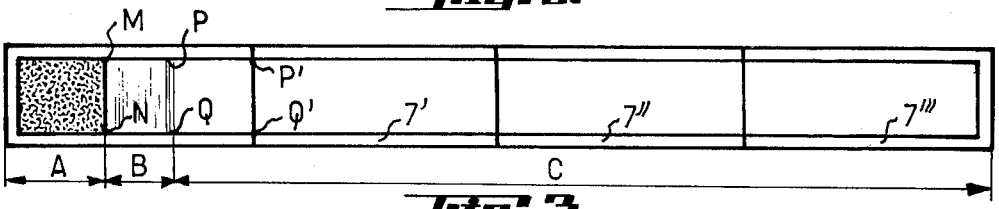
FIG. 2 is a diagrammatic top view of an ingot casting mould according to a second form of embodiment of the present invention, the mould being in this case constituted by four longitudinally juxtaposed elements.
Figure 3:
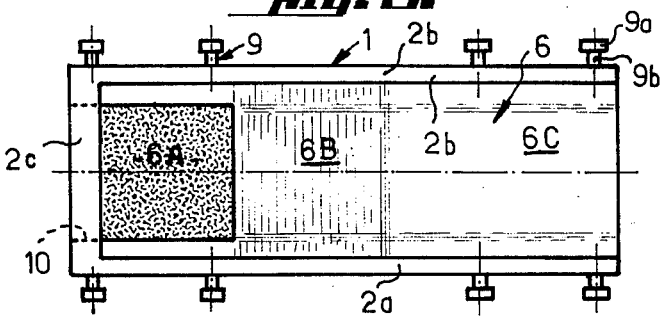
FIG. 3 is a top view of the first element of an ingot casting mould according to a particular embodiment of the present invention.
Figure 4:
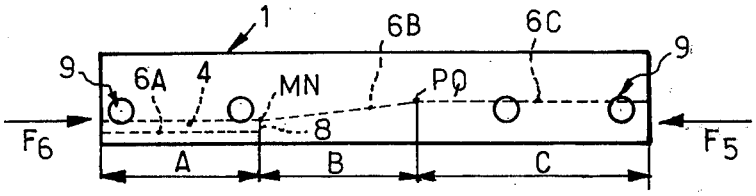
FIG. 4 is an elevational view of the mould of FIG. 3.
Figure 5:
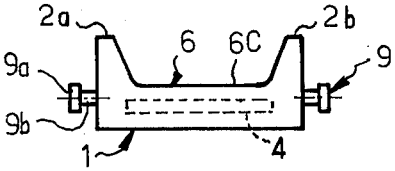
FIG. 5 is an end view, in the direction of arrow $F_5$ of FIG. 4, of the mould of FIGS. 3 and 4.
Figure 6:
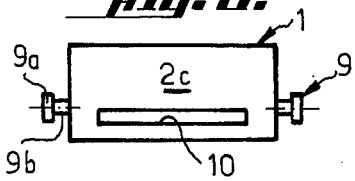
FIG. 6 is an end view, in the direction of arrow $F_6$ of FIG. 4, of this same mould.

The ingot mould of FIG. 2 is constituted by four elements 7, 7′, 7″ and 7‴ juxtaposed one after another. The three sections A, B and C displaying the same features as in the form of embodiment of FIG. 1 are again found in this case; it will be noted that elements 7′, 7″ and 7‴ have one and the same well-known conventional structure; of course, the mould of the present invention may comprise as many intermediate elements, such as 7′ and 7″ as are necessary.

Reference is now made to FIGS. 3 to 6 where the elements identical with or similar to those of FIGS. 1 and 2 are designated by the same reference as in the latter; it is seen that the bottom 6 of the cast-iron body 1 comprises three different portions, i.e. a plane and horizontal portion 6A which is rectangular in shape, a portion forming an inclined plane or upgrade 6B rising progressively from the upstream side of portion 6A, which upstream side forms an offset 8, and a plane and horizontal portion 6C extending from the downstream open end of the mould element shown in FIGS. 3 to 6, the said element being intended to be connected to other elements, as illustrated in FIG. 2. The downstream wall 2 is provided with an obturable opening 10 opposite the plate 4.

The recess limited by the offset 8 of the bottom of the mould body is occupied by a plate 4 of carbon or other material capable of resisting to physical or chemical erosion by the metal stream fed into the upstream region of the mould.

It will also be noted that the ingot mould of FIGS. 3 to 6 is provided with gripping means 9 placed on its side walls 2*b* and 2*c* and which in this case are considered to be constituted by pins 9*a* provided with a head 9*d*. The said gripping means allow suitable devices and/or machines to grip, raise and displace the mould in a manner known per se, in order to perform the lifting of the latter, its horizontal displacement or its overturning. Thus, the mould shown in FIGS. 3 to 6 may be readily handled by a lifting beam controlled by a double-lifting overhead crane.

The ferromanganese casting operations by means of the ingot mould of the present invention will now be described with reference to the appended FIGS. Liquid ferromanganese is poured onto the carbon plate 4 and immediately forms a liquid bed into which the metal stream arrives; the free surface of the liquid bed progressively rises and its downstream edge moves progressively, over the width of the mould bottom, along the section B to reach the region PQ; the cast iron of the mould bottom 6C is therefore in contact with metal which is sufficiently cooled to avoid rapid erosion, all the more so as the said metal advances substantially over the whole width of the mould bottom, without preferential axial flow; the mould is so dimensioned as to obtain, after cooling, a fragmented product whose grain size is as close as possible to the desired grain size, thus avoiding the crushing expenses of the method of casting on slabs or the too fine grain size of the casting method using a continuous bucket chain; on the other hand, in order to better control the cooling speed of the moulds, the latter are placed on a metal frame instead of being placed on the ground.

The ingot moulds are pre-heated before each melt by being positioned on those of the preceeding melt, and then immersed into a limewater solution which, after drying, leaves on the mould surface a non-polluting refractory film or screen; the drying takes place through simple evaporation, owing to the pre-heating undergone by the moulds.

After the cooling of the ferromanganese in the ingot moulds, the latter are taken onto the casting area, as indicated previously, and overturned for discharge onto a storage area or directly into transportation lorries or trucks. Cast iron consumption per ton of produced ferromanganese is very low while at the same time allowing ingot moulds of very simple structure to be obtained without complicating the processes of casting, cooling, transportation beyond the casting area and discharge.

Of course, the invention is by no means limited to the form of embodiment which has been described and which has been given by way of example only. It comprises all the technical equivalents of the means described and the combinations thereof if same are used within the gist of the invention and the scope of the appended claims.

What is claimed is:

1. Ingot casting mould, consisting of a cast-iron body having a closed upstream end and a closed downstream end and successively comprising, from said upstream end to said downstream end at least one first section, the bottom wall of which is provided with a refractory material layer, a second section, having an inclined bottom rising progressively from the adjacent downstream edge of said layer, and a third section having a flat bottom connected to the downstream edge of the inclined bottom of said second section.

2. Ingot casting mould according to claim 1, characterized in that the aforesaid layer is of carbon.

3. Ingot casting mould according to claim 1, characterized in that it is constituted by a plurality of longitudinally juxtaposed elements, comprising a first element including at least the aforesaid first and second sections and being open at its downstream end, intermediate elements open at both their ends and a downstream element open at its upstream end.

4. Ingot casting mould according to claim 1, wherein gripping means are provided.

* * * * *

UNITED STATES PATENT AND TRADEMARK OFFICE

CERTIFICATE OF CORRECTION

PATENT NO. : 4,032,104

DATED : June 28, 1977

INVENTOR(S) : Francis Joseph Antoine Pepin

It is certified that error appears in the above-identified patent and that said Letters Patent are hereby corrected as shown below:

The correct name of the Assignee is -

Societe Nouvelle des Acieries de Pompey.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*